United States Patent [19]

Chahanian

[11] 4,382,343

[45] May 10, 1983

[54] STRETCHING MACHINE

[75] Inventor: André Chahanian, Alfortville, France

[73] Assignee: Chaussures Helene, Verneuil l'Etang, France

[21] Appl. No.: 226,398

[22] Filed: Jan. 19, 1981

[30] Foreign Application Priority Data

Jan. 30, 1980 [FR] France ..... 80 01979
Dec. 1, 1980 [FR] France ..... 80 25418

[51] Int. Cl.[3] ..... B27F 07/15; B44D 03/18
[52] U.S. Cl. ..... 38/102.91; 227/13
[58] Field of Search ..... 227/12, 13; 38/102, 38/102.91; 269/254 R; 254/199

[56] References Cited

U.S. PATENT DOCUMENTS

| | | | |
|---|---|---|---|
| 1,315,645 | 9/1919 | Stappler | 227/12 |
| 1,745,594 | 2/1930 | Altman | 227/12 |
| 2,214,738 | 9/1940 | Eisenstein | 227/12 |
| 2,562,469 | 7/1951 | Lindstrom | 227/12 |
| 3,840,167 | 10/1974 | Otteman et al. | 227/13 X |

FOREIGN PATENT DOCUMENTS

| | | | |
|---|---|---|---|
| 33695 | 8/1981 | European Pat. Off. | 227/13 |

*Primary Examiner*—Louis Rimrodt
*Attorney, Agent, or Firm*—Robert Scobey

[57] ABSTRACT

A framework for a canvas is placed on an anvil that is laterally movable below a nailing head. The canvas is held by a clamp which is movable to stretch the fabric prior to mailing.

14 Claims, 14 Drawing Figures

STRETCHING MACHINE

BACKGROUND & BRIEF DESCRIPTION OF THE INVENTION

The invention relates to automatically or semi-automatically attaching a canvas or the like onto a framework.

A canvas used in painting, for example, is obtained by fastening, such as nailing or stapling, the edges of the surface of the canvas onto the edges of a framework. This operation is typically carried out manually, and requires much time, it is difficult to obtain an even tension over the entire canvas, and bubbles or folds are formed which bother the painter. The placing of a canvas onto a framework is generally done by an artisan trained for several years in the practice.

The present invention remedies this inconvenience and permits the mounting of a canvas onto a framework by a person not so qualified, utilizing a machine which replaces manual functions automatically.

In accordance with the present invention, the machine is characterized by a laterally movable support for holding the framework and moving it below a nailing or stapling head, along with a means for holding the canvas and ensuring the proper tension of the canvas before it is affixed to the framework.

A feature of the invention is a means holding the canvas in an inwardly curved clamp which is mounted on the shaft of a jack. Other features include a pneumatic or hydraulic piston/cylinder mechanism for actuating the canvas clamping means.

Thus the stapling or nailing is carried out precisely at the desired point or placement, and the canvas at this point is stretched over the framework. The command for these operations takes place through the use of a foot pedal control mechanism which frees use of the hands.

Other characteristics and advantages of the invention will be apparent from the following detailed description of representative embodiments of the invention, with regard to the following figures:

BRIEF DESCRIPTION OF THE DRAWINGS

FIG. 13 being a sectional view taken on section XIII in FIG. 12.

DETAILED DESCRIPTION

Figure 1:
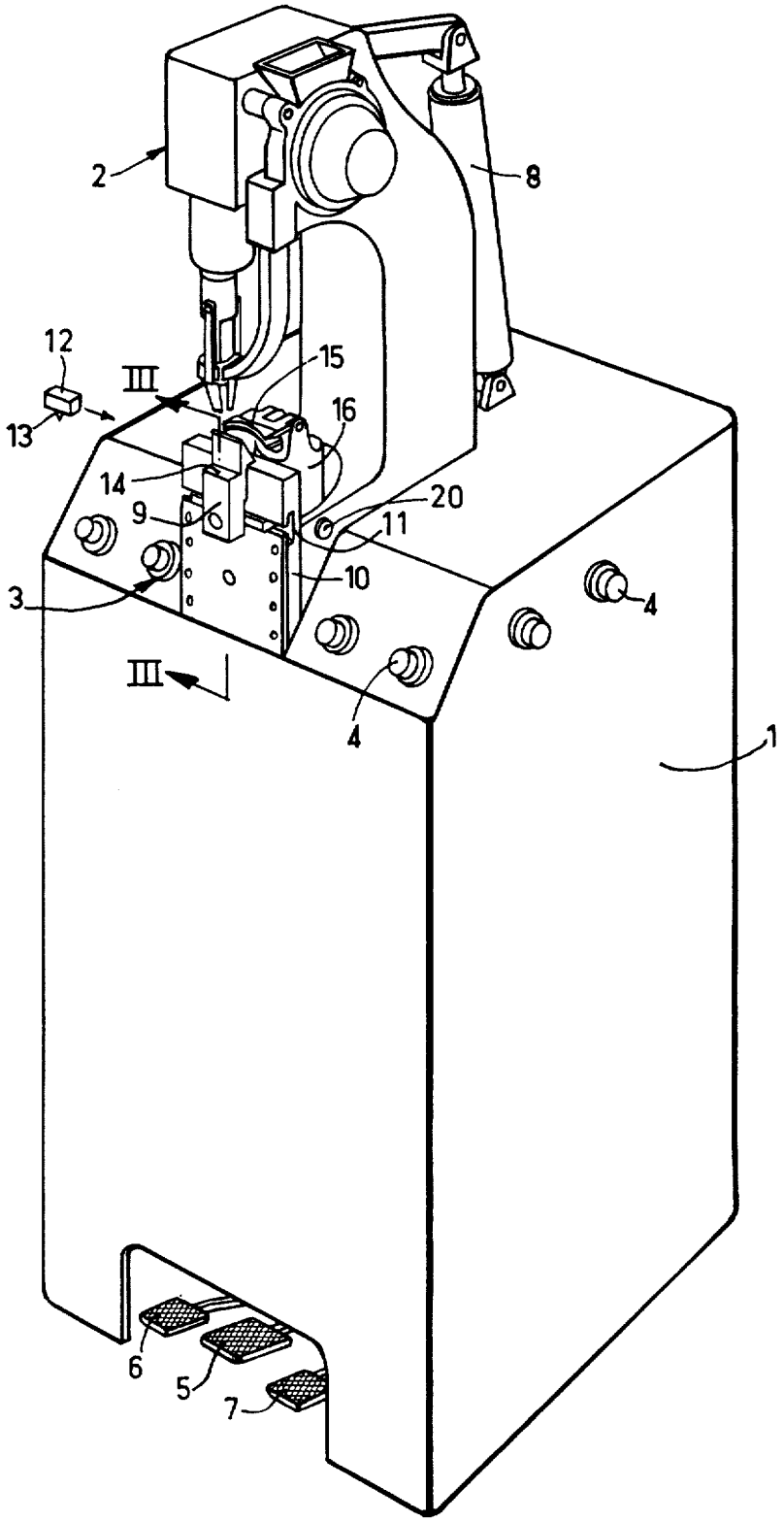
FIG. 1 is a perspective view of a machine for placing canvas on a framework.

Referring to FIG. 1, it is seen that the machine is composed of a structure 1 and a fastening head 2, for example, for nailing, that is mounted above the structure 1 and which permits a one-by-one distribution of nails, staples, or the like. Preferably, nails used are small nails employed for tapestry. The nailing head is above a support 3 which holds the framework at the time of nailing. The structure 1 encloses all the electromechanical, pneumatic and hydraulic elements of the machine. The push buttons 4 are for placing the machine into an operative state, the actual control of the operations of the machine being achieved through operation of foot pedals 5, 6 and 7. Other than its function of introducing fasteners such as nails or staples, the head 2 also achieves the penetration of these nails or staples into the wood of the framework under the action of a jack 8, for example, a pneumatic jack. Nailing heads of this type are well known, and further description is not necessary.

Principal features of the machine lie in the support apparatus and in the tension clamp. The support, designated by the reference numeral 3, is comprised of an anvil 9 which is laterally movable by sliding along a fixed piece 10, in a T-shaped groove 11, for example. On the anvil 9 may be mounted blocks 12 (the block 12 is representative of the actual framework to be nailed or stapled) through the use of a nipple 13 which rides along a track 14. In general, the thickness of the wood making up the framework may vary, and it is necessary, in view of the nailing, that all the exterior surfaces be at the same level, whatever the width of the upright and cross pieces of the framework, after placing on the machine.

Figure 11:
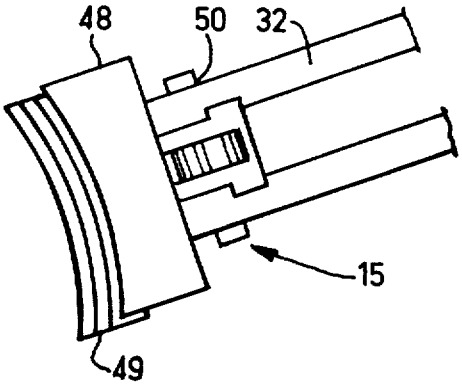
FIG. 11 is a perspective view of the canvas-holding clamp.
Figure 14:
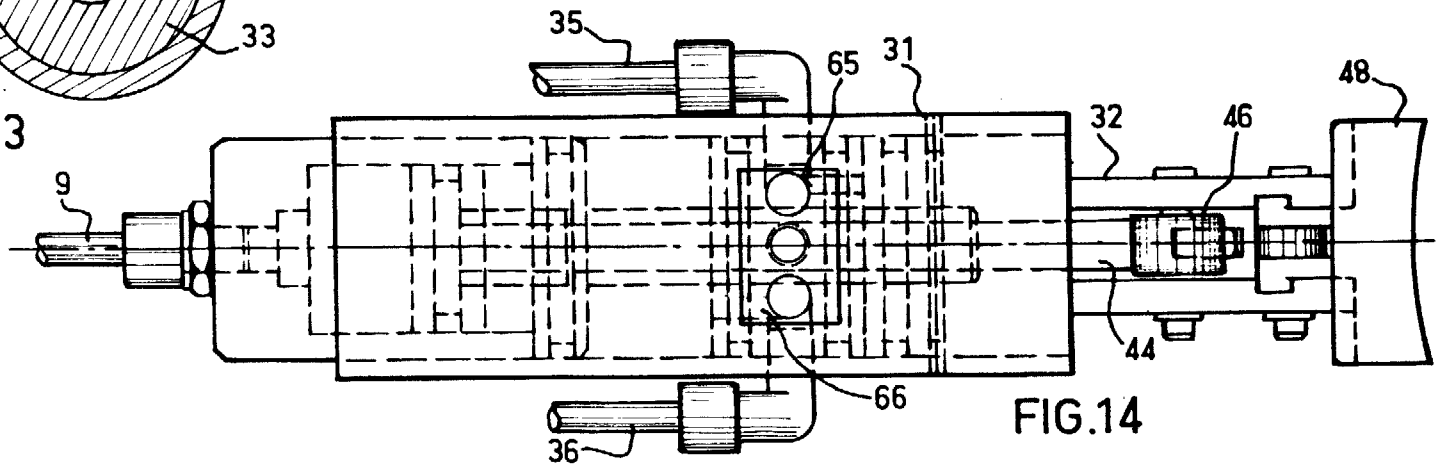

Another feature of the invention involves, as shown in FIGS. 11 and 14, the grasping of the canvas by a clamp 15 curved inwardly so that it clasps simultaneously several fibers of the woof of the canvas and pulls on them without tearing.

Figure 2:
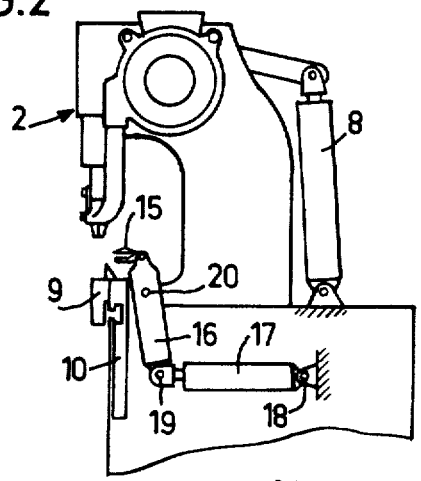
FIG. 2 is a side view of the upper part of the machine of FIG. 1.

FIG. 2 is a diagrammatic representation of the nailing head 2 and the nailing jack 8; also shown are two jacks 16 and 17 which control the clamp 15. It is necessary and effective for the clamp to carry out the function of grasping or holding the canvas, and that it also have the capacity of being repositioned or moved to carry out the function of tensioning the canvas. In the diagrammatic representation of FIG. 2, the first function (which is the holding function) is effected by the jack 16, and the second function (that of repositioning) is effected by the jack 17. In order to achieve this, the jack 16 is mounted pivotally about an axis 20 which connects it to the support structure of the machine. The jack 16 effects the opening and closing of the clamp 15 respectively at the time of relaxing of tension on the canvas after the nailing and before application of tension on the canvas. The tensioning function is effected by jack 17 which is joined to the support structure at its extremity 18. Jack 16 itself is articulated or joined to the jack 17 at the point 19. Of course, other articulation apparatus and arrangements may be employed without departing from the spirit of the invention.

Figure 3:
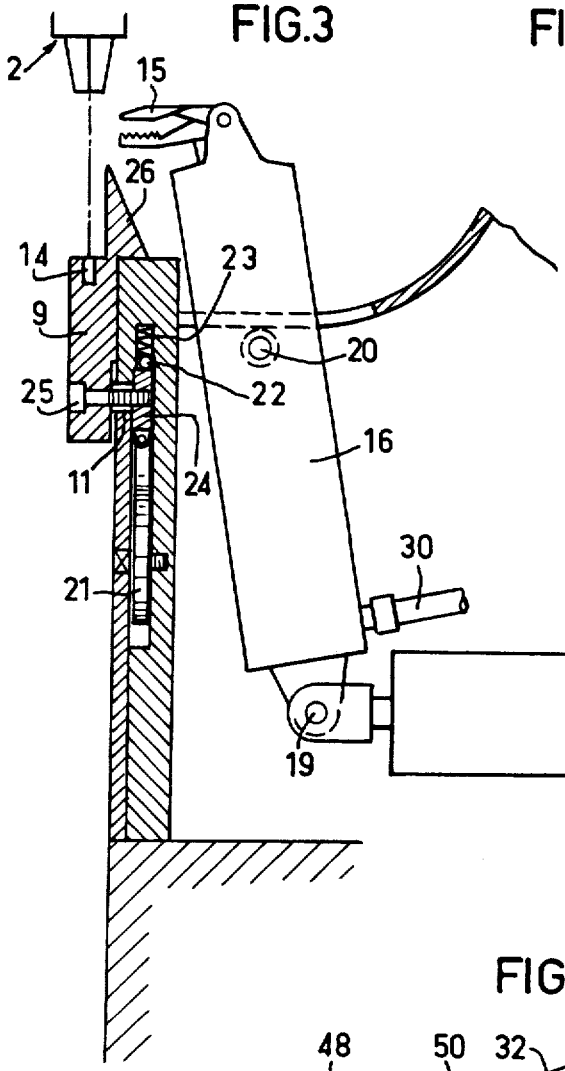
FIG. 3 is a sectional view along the line III—III of FIG. 1.

FIG. 3 is a cross section showing the support piece 10 and the T-shaped groove 11, and means 21 such as a spring for returning the anvil 9 to its left position (with reference to FIG. 1) in which it is situated immediately below the nailing head. This position is obtained automatically when the spring 21 has brought back the anvil 9 towards the center (see also FIG. 8). This action is achieved by the action of a ball 22 biased by a spring 23. This ball penetrates the interior of a notch of tenon 24 that slides in the T-shaped groove and is connected to the anvil 9 by a bolt 25. The upper part of the anvil 9 forms a triangular projection 26 that serves as a prop for the framework at the time of nailing.

Figure 4:
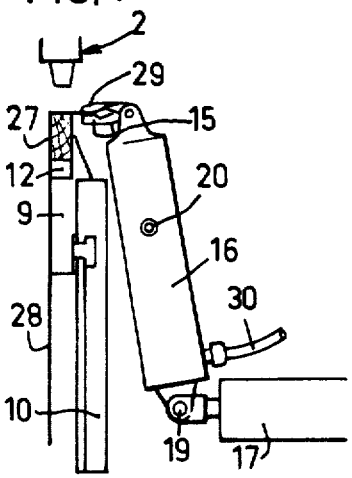
FIGS. 4 to 7 demonstrate the operation of the tensioning apparatus throughout the nailing cycle.
Figure 5:
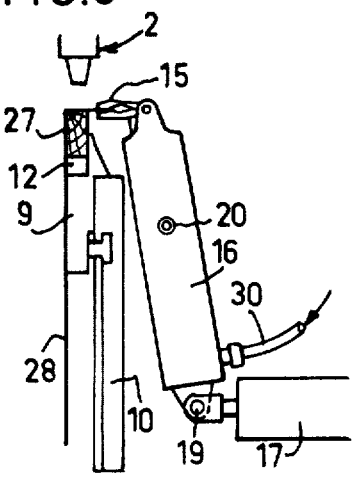
Figure 6:
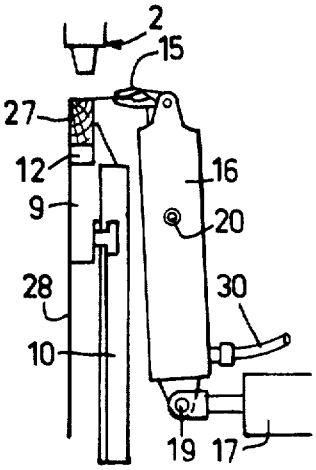
Figure 7:
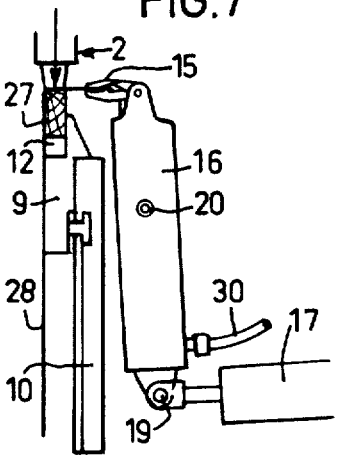

The elements previously mentioned are found again in FIGS. 4 to 7 which present the position of the different components throughout the nailing operation. In FIG. 4, framework 27 for holding the canvas, which appears in cross-section, is set by the intermediary block 12 on the anvil 9. The clamp 15 comes to the edge 29 of canvas 28. As is represented in FIG. 5, the next operation consists of the closing of the clamp 15, which is effected by the introduction of fluid under pressure into fluid line 30 leading to the jack 16. The clamp is thus closed and the canvas is clasped between the jaws of the clamp. Next, as is represented in FIG. 6, the tensioning of the canvas is achieved by pivoting the jack 16 around its axis 20 by the action of the shaft of jack 17 (which moves to the left in FIG. 6). The components then stay in this position, and the nailing head 2 descends to a point of contact with the upper surface of the framework 27, as is represented in FIG. 7. The nailing is then executed by pressing pedal 7, the clamp 15 is opened and the framework 27 is repositioned by lateral movement to the position of the next nailing.

Figure 8:
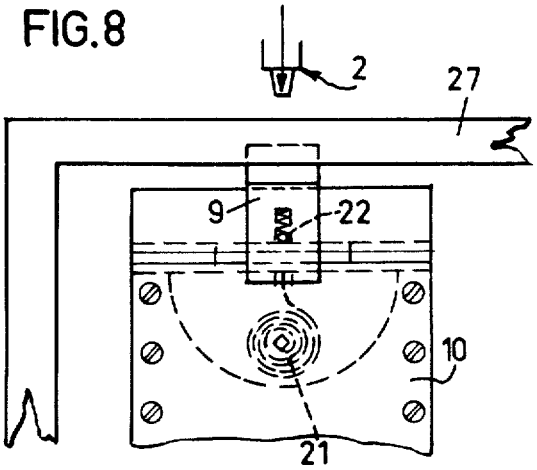
FIGS. 8, 9 and 10 illustrate the changing position of the canvas-holding framework throughout the nailing of one of the sides.
Figure 9:
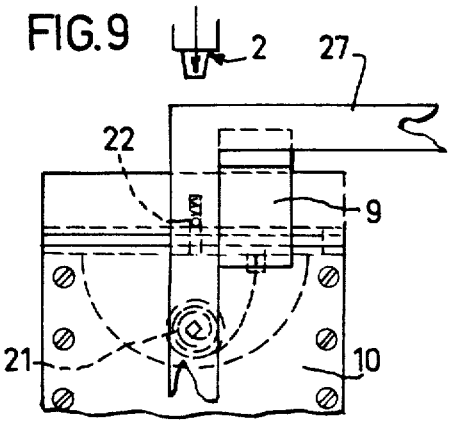
Figure 10:
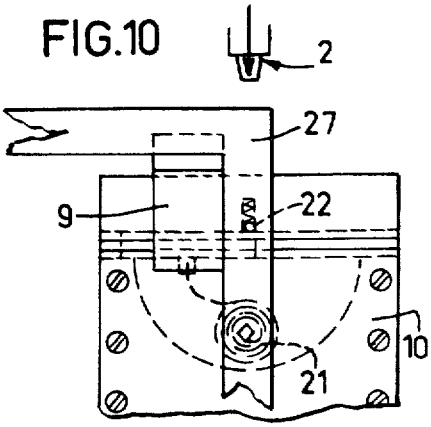

FIGS. 8 to 10 diagram the operations of nailing the canvas on the edge of a framework. As is represented in FIG. 8, one proceeds first by nailing the middle of the canvas to the middle of the frame. The frame is then moved to the right step-by-step. When the edge of the frame that is perpendicular to that which is being nailed at the time comes into contact with the anvil 9, the anvil is repositioned towards the right by tightening the spring 21, as is represented in FIG. 9. This permits the nailing of edges where the parts of the framework present an angle. The framework is then brought back toward the center, the anvil 9 automatically resumes its position of rest under the conjoined actions of the spring 21 and the ball 22, and is then repositioned step-by-step towards the left of the figure, as before, when the perpendicular edge of the frame comes into contact with the anvil towards the left by tightening the spring 21, as represented by FIG. 10. It is of course possible to substitute the spiralling spring 21 with two springs of the hair pin type, for example, and the same result will be obtained.

FIG. 11 shows a preferred form of clamp. It is composed of two jaws 48 and 49, the jaw 49 being movable and articulated to the fixed jaw 48. As is characteristic of this invention, the jaws are curved inwardly so that they may simultaneously hold several threads of the woof of the canvas and thus avoid all risk of tearing at the time of tensioning the canvas.

Figure 12:
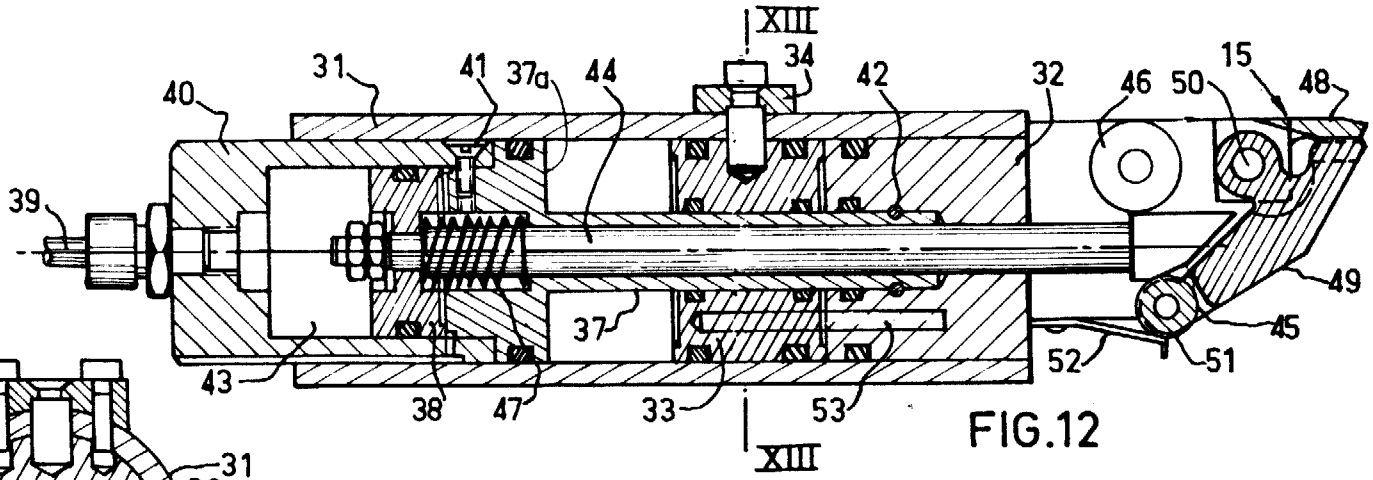
FIGS. 12, 13 and 14 are views of a jack that operates the clamp.
Figure 13:
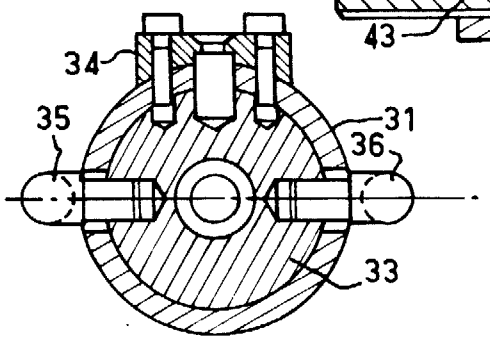

FIGS. 12 to 14 show a preferred form of jacks in a compact assembly achieving the double function of holding and tension which is the task required of the clamp. As described above, the clamp must be able to immobilize the canvas between its jaws and reposition itself in order to achieve a tension before nailing. An advantage of this technique, as it is shown in FIGS. 12 to 14, is that the repositioning of the clamp is rectilinear, specifically horizontal. In this arrangement, the first jack with a simple effect is mounted in the interior of a jack with a double effect. The objective of the first jack is the closure of the clamp, and the objective of the second jack is traction while the clamp is closed over the canvas.

In FIGS. 12 to 14, body 31 remains fixed or still during an operation. In these figures, the clamp is in closed position, and the traction jack is positioned behind. The clamp itself is mounted on a block support 32 itself sliding on the interior of body 31. In FIG. 12, the support 32 is shown in position behind or in the retracted position. In this position, the block support 32 abuts against stopping block 33 which is screwed into the interior of the body by means of an auxiliary piece 34. Fluid lines 35 and 36, linked to an air or other fluid compressor (not shown), are coupled to the piece 34. In the interior of the body 31 is also found a piston 37 that repositions the clamp and which is attached to the block support 32 and to piston 38 which controls the opening and the closing of the clamp 15. To this extent, the piston 37 can be thought of as having 2 piston heads: one is the block support 32 which engages one side of abutment 33, while the other is portion **37*a* which contacts the other side of the abutment. The piston 38 can reposition itself in the interior of the cylinder in a chamber 43 under the pressure of a fluid, such as air, which is introduced via a line 39. The movement of piston 38 towards the front (to the right in FIG. 12) compresses a return spring 47. The chamber 43 is formed by a cylinder 40 attached to piston 37 by screws 41, only one of which is shown in FIG. 12. The repositioning of piston 38 in the chamber 43 longitudinally repositions shaft 44 that terminates in a socket 45 forming a cam. The movement of the socket is guided by a friction roller 46 which is pivotally mounted on the block support 32. The clamp itself comprises an upper jaw 48 which is fixed and a lower jaw 49 which pivots about the horizontal axis 50. The lower part of the jaw 49 is terminated by a cylindrical heel 51 that cooperates with the cam 45. A return spring constituted by thin plate 52 automatically returns the jaw 49 into open position. The shaft 44 is guided at the time of longitudinal repositioning by sliding in the interior of piston 37**.

The piston 37 repositions itself in the interior of the body 31 under the action of a fluid under pressure which is introduced via one of fluid lines 35 and 36. The piston 37 is bound to the block support 32 by clip or spring 42, so that the block support 32 follows the movements of piston 37, and is guided by the axis 53. Depending upon whether the fluid is introduced by line 35 or the line 36, the pressure exerts itself either on the block 32 to make it go forward (to the right in FIG. 12) or to make it draw back (to the left in FIG. 12). The different fluid tight joints that are necessary are shown and are conventional.

The operation of this apparatus is as follows. From the position shown in the figures, the first operation consists of opening the clamp and making it approach the canvas to be held. To this effect, the pressure applied on the line 39 is reduced, and the spring 47 repositions shaft 44 towards the rear (to the left in FIG. 12), an action which disengages the socket 45 from the heel 51. The spring 52 bears against the heel 51, and the jaw 49 is opened by pivoting about axis 50. Almost simultaneously, the line 35 is opened, and via channel 65 the fluid under pressure is applied to the internal face of block 32, which repositions itself to the front (towards the right in FIG. 12) just until the internal face of piston 37 abuts against the stopping piece 33. The closing of the clamp is then obtained by opening the fluid line 39, an action which pushes back piston 38 and shaft 44 so that socket 45 contacts heel 51. The jaw 49 thus pivots about the axis 50 and the clamp is closed.

The next operation consists of the tensioning of the canvas which results from the withdrawal movement of the clamp via the block support 32. The withdrawal movement is obtained by relieving the pressure in fluid line 35 and in pressuring the fluid line 36 via the intermediary channel 66. Pressure is thus applied on the internal face of the piston 37, and the piston draws back (towards the left in FIG. 12) just until the block 32 comes into contact with the abutment 33. Throughout this repositioning, the piston 37 draws along the cylinder 40, and the canvas is stretched with a pull corresponding to the movement of the piston 37, the pressure applied by the line 39 being maintained throughout this operation.

After nailing, the extremity of the canvas must be disengaged from the jaws 48 and 49, an action which is obtained as previously described by the suppression of the pressure in line 39 and the action of the spring 47 and spring 52. In this fashion, the opening of the clamp is obtained by a jack of simple effect and the repositioning of the clamp is preferably controlled by a cylinder of double effect. The control of these different operations may be carried out by an assembly of pedals. In the event that the canvas or any other piece of textile must be stretched and fastened to a framework or support of which the dimensions exceed those of the machine, it is possible to disengage the apparatus just described in order to reposition it.

A machine as just described may be easily used, and does not require great skill in its operation. The structure of the machine permits the operator to work in front of it, so that he can follow at all times the cycle of work and intervene as necessary. The use of plural nailing or stapling heads operating simultaneously or sequentially is possible. While the framework operated upon is normally repositioned manually, except for the step-by-step movement of the anvil described above, fully automatic repositioning is possible.

It is apparent that modifications can be made to the preferred embodiments described above, particularly by substituting equivalent features for those shown and described without departing from the spirit of the present invention. Thus the invention should be taken to be defined by the following claims.

I claim:

1. A machine for attaching a canvas or the like to a framework by means of fasteners applied by a fastening head, comprising an anvil for supporting the framework and positioned adjacent to said fastening head and movable laterally with respect to said fastening head to move said framework past said fastening head, and clamp means for both holding and stretching said canvas before each application of fasteners by said fastening head.

2. A machine according to claim 1, in which said clamp means comprises clamping jaws, a first jack for closing said jaws to hold said canvas, and a second jack for moving said closed jaws to cause said canvas to be stretched.

3. A machine according to claim 2, in which said first jack is articulated at a mid section thereof to a fixed axis and at an end thereof to the extremity of a shaft of said second jack.

4. A machine according to claim 2, in which said first and second jacks comprise pistons movable along a common axis and independently actuatable.

5. A machine according to claim 2, in which said first jack includes a piston attached to a shaft of which an extremity bears against said jaws to actuate the latter, said shaft passing through a piston of said second jack.

6. A machine according to claim 2, in which said first jack comprises a shaft for actuating said jaws, said shaft being slidable in a first piston mounted for sliding movement rearwardly and forwardly in a first cylinder, a second piston mounted to said shaft and movable with respect to said first cylinder, and a support for mounting said jaws to said first piston.

7. A machine according to claim 6, in which said first piston comprises two piston heads on opposite sides of an abutment within said first cylinder.

8. A machine according to claim 7, in which said shaft terminates at one end in a socket for actuating said jaws and at its other end in said second piston.

9. A machine according to claim 8 in which said second piston is slidable in a second cylinder that is in turn slidable within said first cylinder, said second cylinder being attached to said first piston.

10. A machine according to claim 9, in which said second piston is mounted for limited movement within said second cylinder, and is biased toward a position at one end of said second cylinder.

11. A machine according to claim 1, in which said clamp comprises a fixed jaw and a movable jaw pivotable about an axis, a spring biasing said movable jaw into one of open and closed positions, and an actuating shaft movable against said movable jaw to move the latter to the other of said open and closed positions.

12. A machine according to claim 1, in which said anvil is movable to both sides of said fastening head from a center position generally opposite said fastening head.

13. A machine according to claim 12, in which said anvil is spring biased to said center position.

14. A machine according to claim 12 or 13, in which said anvil includes a support surface upon which said framework may slide from one position to another opposite said fastening head.

* * * * *